US008071517B2

(12) United States Patent
Dodd et al.

(10) Patent No.: US 8,071,517 B2
(45) **Date of Patent: *Dec. 6, 2011**

(54) MARINE ENGINE LUBRICATION

(75) Inventors: James C. Dodd, Didcot (GB); Jeremy R. Spencer, Didcot (GB)

(73) Assignee: Infineum International Limited, Abingdon (GB)

( * ) Notice: Subject to any disclaimer, the term of this patent is extended or adjusted under 35 U.S.C. 154(b) by 175 days.

This patent is subject to a terminal disclaimer.

(21) Appl. No.: 12/465,685

(22) Filed: May 14, 2009

(65) Prior Publication Data

US 2009/0291868 A1 Nov. 26, 2009

(30) Foreign Application Priority Data

May 20, 2008 (EP) ..... 08104037

(51) Int. Cl.
*C10M 159/22* (2006.01)
*C10M 131/00* (2006.01)
*C10M 169/04* (2006.01)

(52) U.S. Cl. ..... 508/460; 508/502; 508/503

(58) Field of Classification Search ..... 508/460, 508/502, 503

See application file for complete search history.

(56) References Cited

U.S. PATENT DOCUMENTS

| | | | | |
|---|---|---|---|---|
| 6,140,282 | A | 10/2000 | Cartwright et al. | |
| 2003/0195126 | A1 | 10/2003 | Boons | |
| 2004/0121918 | A1 * | 6/2004 | Rea et al. | 508/291 |
| 2004/0138076 | A1 * | 7/2004 | Muir et al. | 508/460 |
| 2005/0119140 | A1 * | 6/2005 | Chambard et al. | 508/572 |
| 2006/0116302 | A1 | 6/2006 | Deckman et al. | |

FOREIGN PATENT DOCUMENTS

| | | | |
|---|---|---|---|
| EP | 1889896 | A2 | 2/2008 |
| GB | 23590093 | A | 8/2001 |
| JP | 2005263861 | A | 9/2005 |

* cited by examiner

*Primary Examiner* — Walter D Griffin
*Assistant Examiner* — Francis C Campanell

(57) ABSTRACT

A trunk piston marine engine lubricating oil composition for a medium-speed compression-ignited marine engine comprises, in a major amount, an oil of lubricating viscosity containing 50 mass % or more of a Group II basestock, and, in respective minor amounts, (A) an overbased metal hydrocarbyl-substituted hydroxybenzoate detergent having a basicity index of 4.5 or less, and (B) an overbased metal hydrocarbyl-substituted hydroxybenzoate detergent having a basicity index of greater than 4.5. The ratio of detergent (A) to detergent (B), both expressed as mass of active ingredient, is in the range from 0.5 to 15. The trunk piston marine engine lubricating oil composition has a TBN (using ASTM D2896) of 20 to 60.

8 Claims, No Drawings

MARINE ENGINE LUBRICATION

FIELD OF THE INVENTION

This invention relates to a trunk piston marine engine lubricating composition for a medium-speed four-stroke compression-ignited (diesel) marine engine and lubrication of such an engine.

BACKGROUND OF THE INVENTION

The use of metal detergents in trunk piston engine oils (TPEO's) is well known and is described in the art. See, for example, U.S. Pat. No. B2-7,053,027. In "The Benefits of Salicylate Detergents in TPEO Applications with a Variety of Base Stocks", Proceedings of the 7$^{th}$ International Symposium on Marine Engineering, Tokyo, Oct. 24 to 28, 2005, criteria for the selection of the best detergent for TPEO's are discussed. The paper states that there is a move towards the use of more Group II base oils in marine lubricants in various regions of the world, based on availability and cost.

The paper concludes that salicylate has advantage over other other detergents as an asphaltene dispersant in both Group I and Group II base stocks. However, in section 1.4, the paper states that overbased detergents show lower stability in Group II oils.

The present invention ameliorates the stability problem in Group II oils by employing specific ratios of overbased metal carboxylate detergents of defined basicity index.

SUMMARY OF THE INVENTION

A first aspect of the invention is a trunk piston marine engine lubricating oil composition for a medium-speed compression-ignited marine engine comprising or made by admixing an oil of lubricating viscosity, in a major amount, containing 50 mass % or more of a Group II basestock, and, in respective minor amounts, (A) an overbased metal hydrocarbyl-substituted hydroxybenzoate detergent having a basicity index of 4.5 or less; and (B) an overbased metal hydrocarbyl-substituted hydroxybenzoate detergent having a basicity index of greater than 4.5, wherein the ratio of detergent (A) to detergent (B), both expressed as mass of active ingredient, is in the range from 0.5 to 15.

A second aspect of the invention is a method of operating a trunk piston medium-speed compression-ignited marine engine comprising (a) fueling the engine with a heavy fuel oil, and (b) lubricating the crankcase of the engine with a composition according to the first aspect of the invention.

A third aspect of the invention is a method of improving the stability of overbased metal detergents, in a trunk piston marine engine lubricating oil composition for a medium-speed compression-ignited marine engine, comprising an oil of lubricating viscosity containing 50 mass % or more of a Group II basestock, which comprises providing detergents (A) and (B) as defined in the first aspect of the invention in respective minor amounts.

In this specification, the following words and expressions, if and when used, have the meanings ascribed below:

"active ingredients" or "(a.i.)" refers to additive material that is not diluent or solvent;

"basicity index" means the equivalents ratio of the total metal to the total of organic acid in an overbased detergent. In the case of salicylate detergents, as used in this invention, it is numerically the same as "metal ratio" which is defined in "Chemistry and Technology of Lubricants", 1992, edited by Mortier and Orszulik;

"comprising" or any cognate word specifies the presence of stated features, 5 steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means in excess of 50 mass % of a composition;

"minor amount" means less than 50 mass % of a composition;

"TBN" means total base number as measured by ASTM D2896.

Furthermore in this specification:

"calcium context" is as measured by ASTM 4951;

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention will now be discussed in more detail below.

Oil of Lubricating Viscosity

The lubricating oils may range in viscosity from light distillate mineral oils to heavy lubricating oils. Generally, the viscosity of the oil ranges from 2 mm$^2$/sec to 40 mm$^2$/sec, as measured at 100° C.

Natural oils include animal oils and vegetable oils (e.g., caster oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogues and homologues thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarlboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dicicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additionally processing using techniques for removing spent additives and oil breakdown products.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV, Analytical Methods for Base Stock are tabulated below:

| PROPERTY | TEST METHOD |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

As stated, the oil of lubricating viscosity contains 50 mass % or more of a Group II basestock. Preferably, it contains 60, such as 70, 80 or 90, mass % or more of a Group II basestock. The oil of lubricating viscosity maybe substantially all Group II basestock.

Overbased Metal Detergent ((A) and (B))

A metal detergent is an additive based on so-called metal "soaps", that is metal salts of acidic organic compounds, sometimes referred to as surfactants. They generally comprise a polar head with a long hydrophobic tail. Overbased metal detergents, which comprise neutralized metal detergents as the outer layer of a metal base (e.g. carbonate) micelle, may be provided by including large amounts of metal base by reacting an excess of a metal base, such as an oxide or hydroxide, with an acidic gas such as carbon dioxide.

In the present invention, overbased metal detergents (A) and (B) are each overbased metal hydrocarbyl-substituted hydroxybenzoate, preferably a hydrocarbyl-substituted salicylate, detergents.

"Hydrocarbyl" means a group or radical that contains carbon and hydrogen atoms and that is bonded to the remainder of the molecule via a carbon atom. It may contain hetero atoms, i.e. atoms other than carbon and hydrogen, provided they do not alter the essentially hydrocarbon nature and characteristics of the group. As examples of hydrocarbyl, there may be mentioned alkyl and alkenyl. The overbased metal hydrocarbyl-substituted hydroxybenzoate typically has the structure shown:

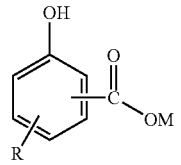

wherein R is a linear or branched aliphatic hydrocarbyl group, and more preferably an alkyl group, including straight- or branched-chain alkyl groups. There may be more than one R group attached to the benzene ring. M is an alkali metal (e.g. lithium, sodium or potassium) or alkaline earth metal (e.g.

calcium, magnesium barium or strontium). Calcium or magnesium is preferred; calcium is especially preferred. The COOM group can be in the ortho, meta or para position with respect to the hydroxyl group; the ortho position is preferred. The R group can be in the ortho, meta or para position with respect to the hydroxyl group.

Hydroxybenzoic acids are typically prepared by the carboxylation, by the Kolbe-Scmitt process, of phenoxides, and in that case, will generally be obtained (normally in a diluent) in admixture with uncarboxylated phenol. Hydroxybenzoic acids may be non-sulphurized or sulphurized, and may be chemically modified and/or contain additional substitutes. Processes for sulphurizing a hydrocarbyl-substituted hydroxybenzoic acid are well known to those skilled in the art, and are described, for example, in US 2007/0027057.

In hydrocarbyl-substituted hydroxybenzoic acids, the hydrocarbyl group is preferably alkyl (including straight- or branched-chain alkyl groups), and the alkyl groups advantageously contain 5 to 100, preferably 9 to 30, especially 14 to 19, carbon atoms.

The term "overbased" is generally used to describe metal detergents in which the ratio of the number of equivalents of the metal moiety to the number of equivalents of the acid moiety is greater than one. The term 'low-based' is used to describe metal detergents in which the equivalent ratio of metal moiety to acid moiety is greater than 1 and up to about 2.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, there are disclosures of nanoparticulate materials comprising carbonate in the crystalline calcite and vaterite forms.

The basicity of the detergents may also be expressed as a total base number (TBN). A total base number is the amount of acid needed to neutralize all of the basicity of the overbased material. The TBN may be measured using ASTM standard D2896 or an equivalent procedure.

Overbased metal hydrocarbyl-substituted hydroxybenzoates can be prepared by any of the techniques employed in the art. A general method is as follows:

1. Neutralisation of hydrocarbyl-substituted hydroxybenzoic acid with a molar excess of metallic base to produce a slightly overbased metal hydrocarbyl-substituted hydroxybenzoate complex, in a solvent mixture consisting of a volatile hydrocarbon, an alcohol and water;
2. Carbonation to produce colloidally-dispersed metal carbonate followed by a post-reaction period;
3. Removal of residual solids that are not colloidally dispersed; and
4. Stripping to remove process solvents, Overbased metal hydrocarbyl-substituted hydroxybenzoates can be made by either a batch or a continuous overbasing process.

Metal base (e.g. metal hydroxide, metal oxide or metal alkoxide), preferably lime (calcium hydroxide), may be charged in one or more stages. The charges may be equal or may differ, as may the carbon dioxide charges which follow them. When adding a further calcium hydroxide charge, the carbon dioxide treatment of the previous stage need not be complete. As carbonation proceeds, dissolved hydroxide is converted into colloidal carbonate particles dispersed in the mixture of volatile hydrocarbon solvent and non-volatile hydrocarbon oil.

Carbonation may by effected in one or more stages over a range of temperatures up to the reflux temperature of the alcohol promoters. Addition temperatures may be similar, or different, or may vary during each addition stage. Phases in which temperatures are raised, and optionally then reduced, may precede further carbonation steps.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The alkanol is preferably methanol although other alcohols such as ethanol call be used. Correct choice of the ratio of alkanol to hydrocarbon solvents, and the water content of the initial reaction mixture, are important to obtain the desired product.

Oil may be added to the reaction mixture; if so, suitable oils include hydrocarbon oils, particularly those of mineral origin. Oils which have viscosities of 15 to 30 $mm^2$/sec at 38° C. are very suitable.

After the final treatment with carbon dioxide, the reaction mixture is typically heated to an elevated temperature, e.g, above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after solvent removal.

The products are generally used as an oil solution. If the reaction mixture contains insufficient oil to retain an oil solution after removal of the volatiles, further oil should be added. This may occur before, or at an intermediate point, or after solvent removal.

Additional materials may form an integral part of the overbased metal detergent. These may, for example, include long chain aliphatic mono- or di-carboxylic acids. Suitable carboxylic acids include stearic and oleic acids, and polyisobutylene (PIB) succinic acids.

As stated, overbased metal detergent (A) has a basicity index of 4.5 or less and overbased metal detergent (B) has a basicity index of greater than 4.5. Preferably, the basicity index of metal detergent (A) is in the range of 1 to 4, more preferably in the range of 1 to 3. Preferably, the basicity index of metal detergent (B) is in the range of 5.5 to 9 more preferably in the range of 6 to 8.

Also as stated, the ratio of detergent (A) to detergent (B) is in the range from 0.5 to 15. Preferably, the ratio is in the range of 0.5 to 10; more preferably the ratio is in the range of 1 to 7.

The treat rate of additives (A) and (B) contained in the lubricating oil composition may for example be in the range of 1 to 25, preferably 2 to 20, more preferably 5 to 18, mass %.

Co-Additives

The lubricating oil composition of the invention may comprise further additives, different from and additional to (A) and (B). Such additional additives may, for example include ashless dispersants, other metal detergents, anti-wear agents such as zinc dihydrocarbyl dithiophosphate, anti-oxidants and demulsifiers.

It may be desirable, although not essential, to prepare one or more additive packages or concentrates comprising the additives, whereby additives (A) and (B) can be added simultaneously to the base oil to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of base lubricants Thus, additives (A) and (B), in accordance with the present invention, may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

The final formulations as a trunk piston engine oil may typically contain 30, preferably 10 to 28, more preferably 12 to 24, mass % of the additive package(s), the remainder being base oil. The trunk piston engine oil has a compositional TBN (using ASTM D2896) of 20 to 60, preferably 25 to 55, more preferably 30 to 45.

EXAMPLES

The present invention is illustrated by but in no way limited to the following examples.

Components

The following components were used:

(A): a calcium salicylate detergent having a TBN of 64 mg KOH/g and a Basicity Index of 1.3

($A^1$) a calcium salicylate detergent having a TBN of 225 mg KOH/g and a Basicity Index of 3.0

(B): a calcium salicylate detergent having a TBN of 350 mg KOH/g and a Basicity Index of 6.0

($B^1$) a calcium salicylate detergent having a TBN of 350 mg KOH/g and a Basicity Index of 8.0.

Base Oil: API Group II base oil

Lubricants

A selection of the above components was blended to give a selection of trunk piston marine engine lubricants. Some of the lubricants are examples of the invention; others are reference examples for comparison purposes. The lubricant compositions are shown in the table below under the RESULTS heading.

Testing

Each lubricant was tested for stability according to the following procedure:

a sample of lubricant (100 ml) was poured into a glass centrifuge tube (100 ml capacity). The filled tube was stored vertically in an oven or cupboard as necessary to provide the required test temperature of ambient (20-30° C.) or 60° C. The condition of the samples was observed and noted initially and then periodically at weekly intervals until the termination of the test.

The overbased metal salicylate detergents were tested in a Group II 600R basestock from Cheveron.

Results

The results of the above testing are summarized in the table below where examples of the invention are denoted by numbers and reference examples by letters.

| | Temperature: | | | | | | | | | | | |
|---|---|---|---|---|---|---|---|---|---|---|---|---|
| Example | AMBIENT Time (Weeks) | | | | | 60° C. Time (Weeks) | | | | | | |
| Detergents/Ratio | I | 1 | 2 | 4 | 12 | I | 1 | 2 | 4 | 6 | 8 | 12 |
| | @ 30 TBN | | | | | @ 30 TBN | | | | | | |
| 1 A:$B^1$/2.906 | C | C | C | C | C | C | C | C | C | C | trace | trace |
| 2 A:B/6.124 | C | C | C | C | C | C | C | C | C | C | trace | trace |
| X A:B/0.008 | C | C | C | C | 0.1 | C | C | C | 0.15 | 0.15 | 0.4 | 0.4 |
| Y A:B/0.344 | C | C | C | C | 0.25 | C | C | C | 0.1 | 0.1 | 0.6 | 0.7 |
| | @ 50 TBN | | | | | @ 50 TBN | | | | | | |
| 3 A:$B^1$/1.052 | C | C | C | — | C | C | C | C | — | — | trace | trace |
| 4 A:$B^1$/2.774 | C | C | C | — | C | C | C | C | — | — | 0.05 | 0.05 |
| P A:B/0.009 | C | C | C | — | 1% hz | C | C | C | — | — | 0.7 | 0.6 |
| Q A:B/0.345 | C | C | C | — | 0.2% hz | C | C | C | — | — | 0.8 | 1.0 |

KEY:

C = clear

Numbers are volume % sediment

% hz = volume % haze

I = initial reading

The results show that, at comparable TBN's and temperatures, the stability of the examples of the invention, depicted by numbers, is superior to the stability of the comparison examples, depicted by letters.

What is claimed is:

1. A trunk piston marine engine lubricating oil composition for a medium-speed compression-ignited marine engine, comprising, or made by admixing, an oil of lubricating viscosity, in a major amount, containing 50 mass % or more of a Group II basestock, and, in respective minor amounts, (A) an overbased metal hydrocarbyl-substituted hydroxybenzoate detergent having a basicity index of 4.5 or less; and (B) an overbased metal hydrocarbyl-substituted hydroxybenzoate detergent having a basicity index of greater than 4.5, wherein the ratio of detergent (A) to detergent (B), both expressed as mass of active ingredient, is in the range from 0.5 to 15; the trunk piston marine engine lubricating oil composition having a TBN (using ASTM D2896) of 20 to 60.

2. The composition as claimed in claim 1 wherein the metal in (A) and in (B) is calcium.

3. The composition as claimed in claim 1 wherein the hydrocarbyl-substituted hydroxybenzoate in (A) and in (B) is a salicylate.

4. The composition as claimed in claim 2 wherein the hydrocarbyl-substituted hydroxybenzoate in (A) and in (B) is a salicylate.

5. The composition as claimed in claim 1 wherein the oil of lubricating viscosity contains more than 60 mass % of a Group II basestock.

6. The composition as claimed in claim 1 wherein the hydrocarbyl group in said overbased metal hydrocarbyl-substituted hydroxybenzoate detergent having a basicity index of 4.5 or less, is an alkyl group of 14 to 19 carbon atoms.

7. A method of operating a trunk piston medium-speed compression-ignited marine engine comprising (a) fueling the engine with a heavy fuel oil, and (b) lubricating the crankcase of the engine with a composition as claimed in claim 1.

8. A method of improving the stability of overbased metal detergents in a trunk piston marine engine lubricating oil composition for a medium-speed compression-ignited marine engine, comprising an oil of lubricating viscosity containing 50 mass % or more of a Group II basestock, which comprises adding a combination of (A) an overbased metal hydrocarbyl-substituted hydroxybenzoate detergent having a basicity index of 4.5 or less; and (B) an overbased metal hydrocarbyl-substituted hydroxybenzoate detergent having a basicity index of greater than 4.5, in respective minor amounts to the composition.

* * * * *